US009636932B2

(12) United States Patent
Takahashi

(10) Patent No.: US 9,636,932 B2
(45) Date of Patent: May 2, 2017

(54) TAPE PRINTER

(71) Applicant: Brother Kogyo Kabushiki Kaisha, Nagoya-shi, Aichi-ken (JP)

(72) Inventor: Ryoya Takahashi, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 257 days.

(21) Appl. No.: 14/468,793

(22) Filed: Aug. 26, 2014

(65) Prior Publication Data

US 2015/0076278 A1 Mar. 19, 2015

(30) Foreign Application Priority Data

Sep. 17, 2013 (JP) ..... 2013-191719

(51) Int. Cl.
*B41J 11/70* (2006.01)
*B41J 13/10* (2006.01)
(Continued)

(52) U.S. Cl.
CPC ..... *B41J 11/703* (2013.01); *B26D 1/305* (2013.01); *B41J 3/4075* (2013.01); *B41J 13/106* (2013.01); *B65H 35/002* (2013.01); *B65H 35/0086* (2013.01); *B26D 2007/005* (2013.01); *B65H 2301/5111* (2013.01)

(58) Field of Classification Search
CPC .. B26D 1/085; B26D 1/305; B26D 2007/005; B41J 11/66; B41J 11/68; B41J 11/70; B41J 11/703; B65C 9/1803; B65C 2210/007; B65H 29/20; B65H 29/22; B65H 29/36; B65H 29/70
See application file for complete search history.

(56) References Cited

U.S. PATENT DOCUMENTS 5,520,382 A * 5/1996 Nakajima ..... B65H 5/222 271/112
5,890,822 A * 4/1999 Saikawa ..... B41J 13/106 101/419
(Continued)

FOREIGN PATENT DOCUMENTS

EP 0636562 * 6/1994 ..... B65H 35/00
JP 61-025867 * 2/1986 ..... B41J 13/14
(Continued)

*Primary Examiner* — Jill Culler
*Assistant Examiner* — Marissa Ferguson Samreth
(74) *Attorney, Agent, or Firm* — Banner & Witcoff, Ltd.

(57) ABSTRACT

A tape printer includes a guide portion guiding a label and having a first and a second guide portion. The first guide portion is arranged on a first end portion side with respect to a central line in a width direction of a feed path such that the portion does not include the central line in the width direction. The second guide portion is arranged on a second end portion side in the width direction such that the portion includes the central line. When a connecting portion connecting the first and the second guide portion is taken as a reference, the first guide portion is formed such that a height of the first guide portion substantially increases toward the first end portion side in the width direction. The second guide portion is formed such that a height of the second guide portion is substantially uniform in the width direction.

5 Claims, 7 Drawing Sheets

(51) Int. Cl.

| | |
|---|---|
| ***B26D 1/30*** | (2006.01) |
| ***B41J 3/407*** | (2006.01) |
| ***B65H 35/00*** | (2006.01) |
| *B26D 7/00* | (2006.01) |

(56) References Cited

U.S. PATENT DOCUMENTS

| | | | | |
|---|---|---|---|---|
| 6,322,068 | B1 * | 11/2001 | Iemura | B65H 29/26 271/177 |
| 6,701,841 | B2 * | 3/2004 | Tsurumaki | B65H 29/70 101/416.1 |
| 7,090,418 | B2 * | 8/2006 | Miki | B26D 1/305 400/621 |
| 8,177,213 | B2 * | 5/2012 | Hirabayashi | B41J 13/106 270/58.07 |
| 8,960,667 | B2 * | 2/2015 | Nakamura | B65H 31/02 271/209 |
| 9,193,555 | B2 * | 11/2015 | Amano | B65H 35/008 |
| 9,248,990 | B2 * | 2/2016 | Morita | B65H 31/00 |
| 2006/0017219 | A1 * | 1/2006 | Yamada | B65H 31/02 271/209 |
| 2008/0067737 | A1 * | 3/2008 | Kosuda | B65H 31/02 271/207 |
| 2010/0008710 | A1 * | 1/2010 | Conway | B41J 11/70 400/223 |
| 2010/0221057 | A1 * | 9/2010 | Shirotori | B26D 1/305 400/621 |
| 2010/0288318 | A1 * | 11/2010 | Beaulieu | A45B 25/02 135/29 |
| 2012/0288318 | A1 | 11/2012 | Nakayama | |
| 2014/0354753 | A1 * | 12/2014 | Takahashi | B41J 11/0025 347/218 |

FOREIGN PATENT DOCUMENTS

| | | | | |
|---|---|---|---|---|
| JP | H05-012145 U | | 2/1993 | |
| JP | 11-48559 | * | 2/1999 | B41J 13/10 |
| JP | H11240223 A | | 9/1999 | |
| JP | 2000-071523 A | | 3/2000 | |
| JP | 2002-60111 | * | 2/2002 | B41J 2/01 |
| JP | 2007-137480 | * | 6/2007 | B65C 3/00 |
| JP | 2007-246273 | * | 9/2007 | B65H 29/70 |
| JP | 2012-236378 A | | 12/2012 | |
| JP | 2013-014015 A | | 1/2013 | |

* cited by examiner

TAPE PRINTER

CROSS-REFERENCE TO RELATED APPLICATION

This application claims priority to Japanese Patent Application No. 2013-191719 filed on Sep. 17, 2013, the disclosure of which is herein incorporated by reference in its entirety.

BACKGROUND

The present disclosure relates to a tape printer that is provided with a function that performs printing on a tape, which is a print medium.

A known type of the printer has, for example, an auto cutter, a paper guide surface and a protrusion. The auto cutter cuts a recording paper, on which information is printed, at a desired length, and forms a slip. The paper guide surface is provided on a downstream side of the auto cutter on a paper feed path, such that it regulates the bottom surface of the slip. The paper guide surface has a step that is one step lower than a transit area of the recording paper in a planar direction. Further, the paper guide surface has a protrusion. The protrusion protrudes in the direction of the slip in an area other than a central portion in the paper width direction of the slip. The slip is held by the paper guide surface and the protrusion, in such a manner that a cut surface on the upstream side of the slip blocks a part of the transit area of the recording paper that is fed.

SUMMARY

With the above-described known structure, even if the protrusion is provided as described above, it is possible that the slip is not smoothly discharged.

Various exemplary embodiments of the general principles described herein provide a tape printer that is provided with a function to perform printing on tapes of a plurality of tape widths and that is capable of more reliably discharging a cut tape.

Exemplary embodiments herein provide a tape printer configured to perform printing on a tape that is a print medium and to create a label by cutting the printed tape. The tape printer includes a cutting portion, a cutting portion and a guide portion. The cutting portion is configured to cut the tape that is fed along a feed path. The discharge port is configured to discharge the label that is created as a result of the tape being cut by the cutting portion, the discharge port being provided on a downstream side of the cutting portion in an extending direction of the feed path. The guide portion is located between the cutting portion and the discharge port in such a manner as to guide the label to the discharge port while supporting one surface of the label. Specifically, the guide portion includes a first guide portion and a second guide portion. The first guide portion is arranged on a first end portion side with respect to a central line in a width direction of the feed path such that the first guide portion does not include the central line in the width direction of the feed path. The second guide portion is connected to the first guide portion. The second guide portion is arranged on a second end portion side in the width direction of the feed path in relation to the first guide portion, such that the second guide portion includes the central line. When a connecting portion, which is a portion connecting the first guide portion and the second guide portion, is taken as a reference, the first guide portion is formed such that a height of the first guide portion with respect to the reference substantially increases toward the first end portion side in the width direction. The second guide portion is formed such that a height of the second guide portion with respect to the reference is substantially uniform in the width direction.

BRIEF DESCRIPTION OF THE DRAWINGS

Exemplary embodiments will be described below in detail with reference to the accompanying drawings in which.

DETAILED DESCRIPTION

Hereinafter, an embodiment will be explained with reference to the drawings. In the explanation of the present embodiment, the right side, the left side, the upper side, the lower side, the front side and the back side of FIG. 1 respectively define the right side, the left side, the upper side, the lower side, the front side and the rear side of a tape printer 1. The lower right side, the upper left side, the lower left side, the upper right side, the upper side and the lower side of FIG. 2 respectively define the upper side, the lower side, the front side, the rear side, the left side and the right side of the tape printer 1 and a tape cassette 30. The tape cassette 30 side of a feed path C and a discharge path that are supplied from the tape cassette 30 is referred to as an upstream side, and a discharge port 20 side is referred to as a downstream side.

The tape printer 1 will be explained with reference to FIG. 1 to FIG. 6. The tape printer 1 is a general-purpose tape printer that can be electrically connected to a computer device (a personal computer, for example). The tape printer 1 is configured to perform printing of characters on a tape, which is a print medium and which is supplied from a tape cassette, the printing being performed based on data of the characters (letters, numbers, graphics and the like) transmitted from the computer device. The single tape printer 1 can be used with various types of the tape cassette 30, such as a thermal type, a receptor type, a laminate type and a tube type. The type of a tape housed inside the tape cassette 30 differs, depending on the type of the tape cassette 30. The type of the tape includes, for example, a heat-sensitive paper tape, a print tape, a double-sided adhesive tape, a tube tape and a film tape. The thermal type tape cassette is provided with a heat-sensitive paper tape. The receptor type tape cassette is provided with a print tape and an ink ribbon. The laminate type tape cassette is provided with a double-sided adhesive tape, a film tape and an ink ribbon. The tube type tape cassette is provided with a heat-shrinkable tube tape and an ink ribbon. In the explanation below, when the types of tape housed in the tape cassette 30 (refer to FIG. 2 and FIG. 3) are collectively referred to or when they are not particularly distinguished, they are simply referred to as a tape. Attributes (for example, a tape width, a print format, a tape color, a print color and the like) of the tape that is housed in the tape cassette 30 are collectively referred to as tape attributes.

Figure 1:
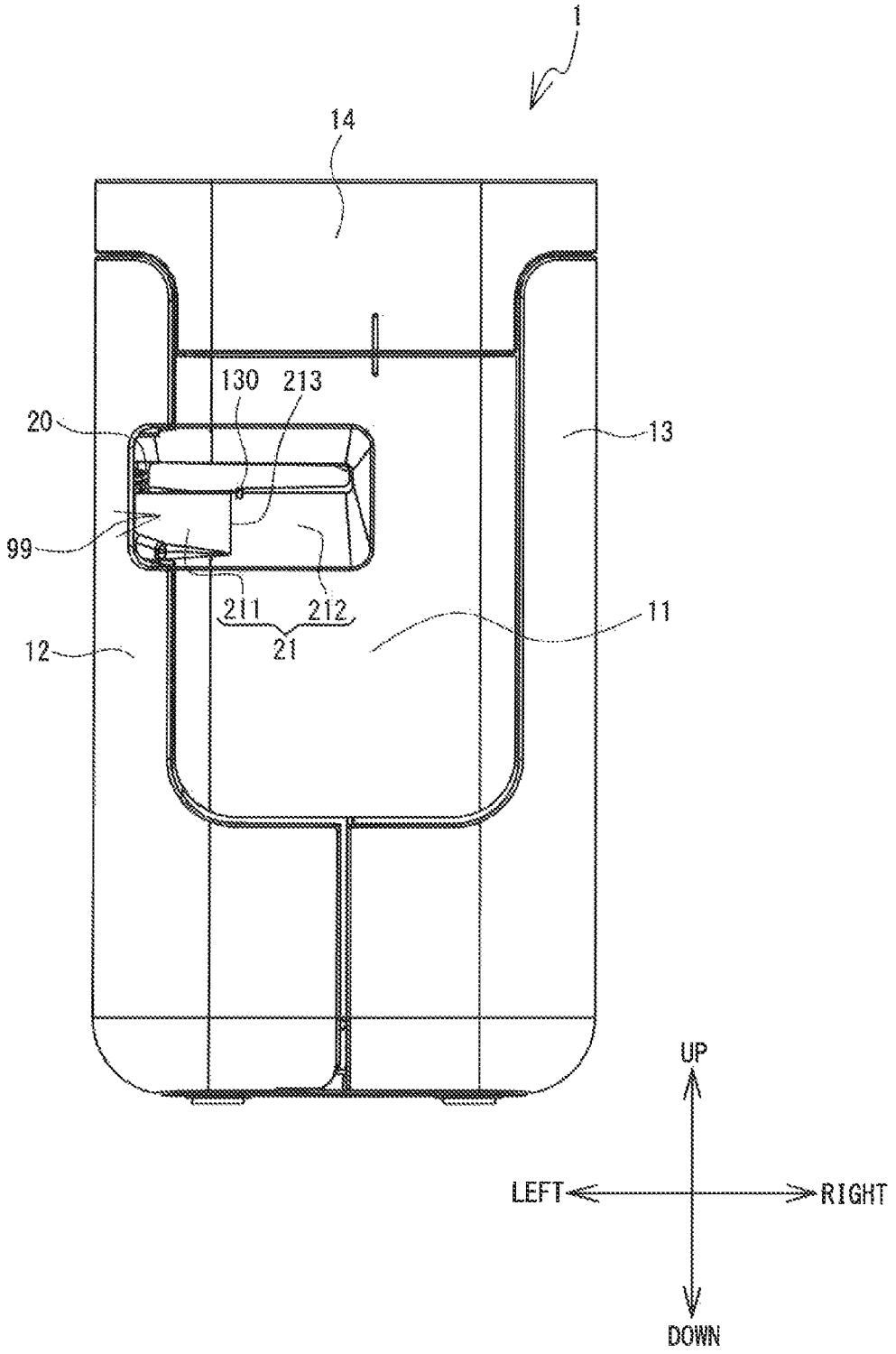
FIG. 1 is a front view of a tape printer.
Figure 3:
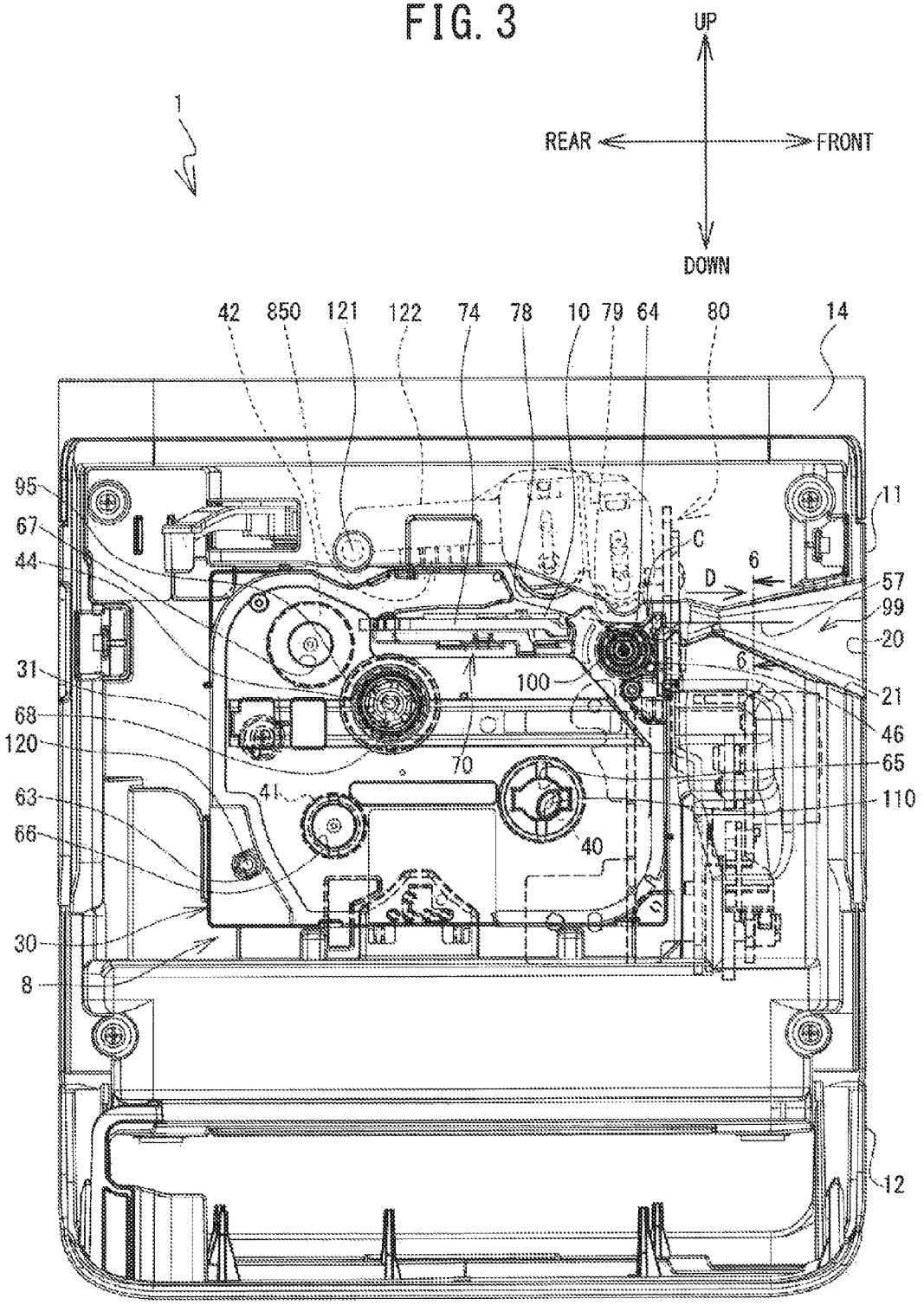
FIG. 3 is a left side view showing the tape printer when the left cover is in the open state and the tape cassette is mounted in the cassette mounting portion of the tape printer.

The tape printer 1 includes a main body portion 11, a left cover 12, a right cover 13 and a top cover 14. As shown in FIG. 1, the left face side, the right face side and the top face side of the main body portion 11 are respectively covered by the left cover 12, the right cover 13 and the top cover 14. As shown in FIG. 3, a cassette mounting portion 8, a printing mechanism 70, a cutting mechanism 80 and a discharge portion 99 are provided on the left face side of the main body portion 11. The cassette mounting portion 8 is a portion into and from which the tape cassette 30 can be mounted and removed. The printing mechanism 70 is a mechanism configured to perform printing on a tape 57 that is supplied from the tape cassette 30. The cutting mechanism 80 is provided on a downstream side of the printing mechanism 70. The cutting mechanism 80 is a mechanism configured to cut the printed tape 57 at a predetermined length. The discharge portion 99 is a portion configured to discharge a label, which is a tape cut by the cutting mechanism 80, to the outside of the tape printer 1. The cassette mounting portion 8, the printing mechanism 70, the cutting mechanism 80 and the discharge portion 99 will be explained later. Although not shown in the drawings, a battery housing portion is provided on the right face side of the main body portion 11. The battery housing portion is a portion that can house a battery that supplies electric power to the tape printer 1.

Figure 2:
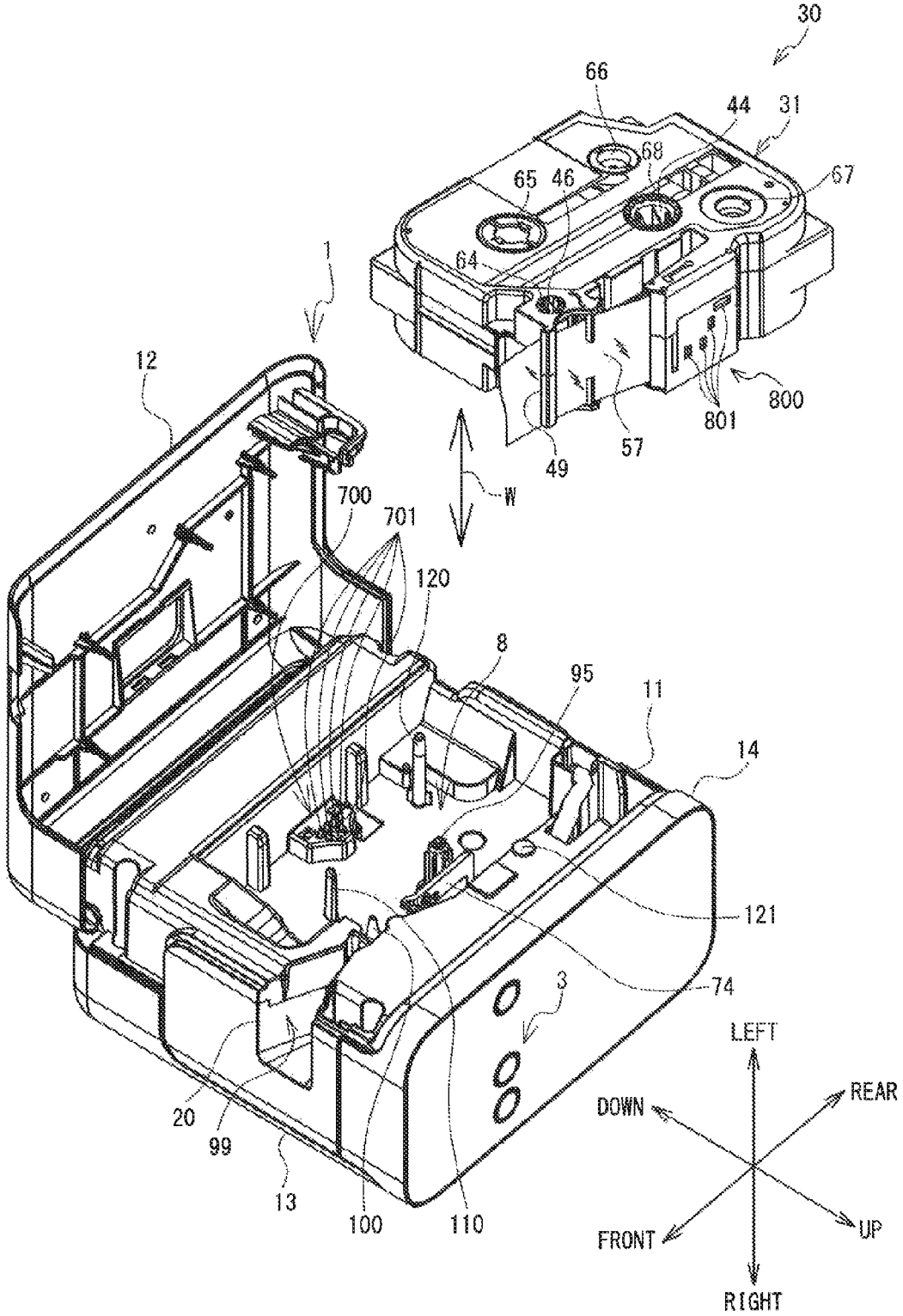
FIG. 2 is a perspective view showing the tape printer when a left cover is in an open state, and a tape cassette before the tape cassette is mounted in a cassette mounting portion of the tape printer.

The left cover 12 is a cover having a rectangular shape in a left side view when it is in a closed state. The left cover 12 is pivotably supported around an axis that runs in the front-rear direction on the lower left portion of the main body portion 11. Specifically, the left cover 12 can pivot between a closed position that is shown in FIG. 1 and an open position that is shown in FIG. 2 and FIG. 3. When the left cover 12 is in the closed position shown in FIG. 1, the left cover 12 covers the left face side of the main body portion 11. The left cover 12 is moved to the open position when the tape cassette 30 is mounted or removed, for example. The right cover 13 is a cover that can be attached to and removed from the main body portion 11 and has a rectangular shape in a right side view. When the right cover 13 is attached to the main body portion 11, the right cover 13 covers the right face side of the main body portion 11. The right cover 13 is operated when the battery is inserted into or removed from the battery housing portion (not shown in the drawings), for example. The top cover 14 is a cover that can be attached to and removed from the main body portion 11. An operation portion 3 is provided on the top surface of the top cover 14. The operation portion 3 is operated when inputting various instructions, such as switching between power on and off.

The tape cassette 30 that can be mounted in the cassette mounting portion 8 will be explained with reference to FIG. 2 and FIG. 3. As shown in FIG. 2, the tape cassette 30 is provided with a substantially rectangular (box-shaped) cassette case 31 that has rounded corners. The shape of the cassette case 31 is the same, irrespective of the type and the tape attributes of the tape cassette 30, except for a first indicator portion 800 and a second indicator portion (not shown in the drawings), which will be explained later.

The cassette case 31 is provided with three support holes 64, 65 and 68 that penetrate in the left-right direction. As shown in FIG. 3, the support hole 64 rotatably supports a roller 46. In cooperation with a movable feed roller 79 that will be explained later, the roller 46 feeds the tape supplied from the cassette case 31 along the predetermined feed path C. Each of the support holes 65 and 68 rotatably supports a spool or the like that is mounted inside the cassette case 31. The support hole 65 rotatably supports a spool 40 around which a tape is wound. The support hole 68 rotatably supports a spool 44 that is used to take up a tape supplied from a spool 42. The cassette case 31 is further provided with support holes 66 and 67 that extend in the left-right direction. The support hole 66 rotatably supports a spool 41 around which a tape is wound. The support hole 67 rotatably supports the spool 42 around which the tape is wound. The cassette case 31 is further provided with a hole 63 that penetrates in the left-right direction in a lower rear portion of the cassette case 31. The tape type of the tape wound on each of the spools 40, 41 and 42 is set in accordance with the type of the tape cassette 30.

As shown in FIG. 2, the top surface of the cassette case 31 is provided with a first indicator portion 800 that indicates some of the tape attributes of the tape cassette 30. The first indicator portion 800 includes at least one hole portion 801, which is provided in a prescribed pattern corresponding to some of the tape attributes of the tape cassette 30. Each of the hole portions 801 is provided in a position that corresponds to one of five switch terminals (not shown in the drawings) that are provided on a first detection portion 850 (refer to FIG. 3) provided on the tape printer 1. As a result, when the tape cassette 30 is mounted in the tape printer 1, the above-described switch terminals are selectively pressed by the first indicator portion 800. In the tape printer 1, some of the tape attributes of the tape cassette 30 are detected based on combinations of the switch terminals of the first detection portion 850 that are on or off. The tape attribute indicated by the first indicator portion 800 is the tape width, for example. The tape width is the length in a width direction W shown in FIG. 2, which is orthogonal to the lengthwise direction of the tape. A minimum tape width Wmin of the tape cassette 30 that can be mounted in the tape printer 1 of the present embodiment is 6 mm. In addition, a maximum tape width Wmax of the tape cassette 30 that can be mounted in the tape printer 1 of the present embodiment is 24 mm. In the present embodiment, the tape that extends from the tape cassette 30 is fed such that a central line of the tape in the width direction W is the same, regardless of the tape width (refer to a central line M shown in FIG. 5 and FIG. 7).

In a similar manner, a second indicator portion (not shown in the drawings) is provided on the lower portion of a right wall of the cassette case 31. The second indicator portion includes at least one hole portion, which is provided in a prescribed pattern corresponding to another of the tape attributes (such as the tape color) that is different to the tape attribute indicated by the first indicator portion 800. Each of the hole portions of the second indicator portion is provided in a position that corresponds to one of five switch terminals 701 that are provided on a second detection portion 750 provided on the tape printer 1 shown in FIG. 2. As a result, when the tape cassette 30 is mounted in the tape printer 1, the switch terminals 701 are selectively depressed by the second indicator portion. In the tape printer 1, the tape attribute of the tape cassette 30 is detected based on combinations of the switch terminals 701 that are on or off at that time. A discharge guide portion 49, which guides the tape 57 toward the cutting mechanism 80, is provided on an upper front portion of the cassette case 31.

The cassette mounting portion 8 will be explained with reference to FIG. 2 and FIG. 3. As shown in FIG. 2, the cassette mounting portion 8 is an area where the tape cassette 30 is insertable and removable in the left-right direction. The cassette mounting portion 8 is provided in a concave manner in a shape that substantially corresponds to a right side surface of the cassette case 31. The second detection portion 700 is provided in a lower right portion of the cassette mounting portion 8. The five switch terminals 701 protrude to the left in the second detection portion 700. As described above, when the tape cassette 30 is mounted in the cassette mounting portion 8, the switch terminals 701 face the second indicator portion (not shown in the drawings) that is provided on the right face side of the tape cassette 30.

The cassette mounting portion 8 is provided with shafts 95, 100, 110 and 120 that extend from the right to the left. The shaft 95 is provided in a standing condition in a central portion in the front-rear direction on the upper side of the cassette mounting portion 8. As shown in FIG. 3, the shaft 95 is a shaft-shaped member that can be inserted into the spool 44 of the tape cassette 30. The shaft 100 is provided in a standing condition in front of the shaft 95. The shaft 100 is a shaft-shaped member that can be inserted into the roller 46 of the tape cassette 30. The shaft 110 is provided in a standing condition below and to the rear of the shaft 100. The shaft 110 is a shaft-shaped member that can be inserted into the support hole 65 of the tape cassette 30. The shaft 120 is provided in a standing condition in a lower rear portion of the cassette mounting portion 8. The shaft 120 is a shaft-shaped member that can be inserted into the hole 63 of the tape cassette 30.

The printing mechanism 70 will be explained with reference to FIG. 3. The printing mechanism 70 is a mechanism configured to perform printing, based on the data that is transmitted from the computer device (not shown in the drawings), on the tape that is supplied from the tape cassette 30 mounted in the cassette mounting portion 8. The printing mechanism 70 is provided with a head holder 74. The head holder 74 is provided in a standing manner on an upper portion of the cassette mounting portion 8. The head holder 74 is formed of a single sheet of a plate-shaped member that extends in the front-rear direction. The top surface of the head holder 74 is provided with a thermal head 10 that includes a heating element (not shown in the drawings).

The printing mechanism 70 is provided with an arm-shaped roller holder 122 that extends in the front-rear direction. The roller holder 122 is provided above the head holder 74. The roller holder 122 is pivotally supported in a rockable manner by the main body portion 11 such that the roller holder 122 can pivot around a shaft support portion 121. A platen roller 78 and a movable feed roller 79 are rotatably and pivotally supported by a front portion of the roller holder 122. The platen roller 78 can approach to and separate from the thermal head 10, in a state in which the platen roller 78 faces the thermal head 10 with the feed path C interposed therebetween. The movable roller 79 can approach to and separate from the roller 46 of the tape cassette 30, in a state in which the movable feed roller 79 faces the roller 46 with the feed path C interposed therebetween. A tape drive motor (not shown in the drawings), which is a stepping motor, is disposed on the back side (the right side) of the cassette mounting portion 8. The shaft 95 and the roller 46 are connected to the tape drive motor via a plurality of gears (not shown in the drawings), respectively, and are configured to rotate in accordance with the drive of the tape drive motor.

When the left cover 12 is in the closed position, the roller holder 122 moves toward a printing position. In the printing position, the roller holder 122 is in close proximity to the cassette mounting portion 8. Specifically, when the tape cassette 30 is mounted in the cassette mounting portion 8, the platen roller 78 presses the thermal head 10 via the print tape and the ink ribbon (not shown in the drawings). At the same time, the movable feed roller 79 presses the roller 46 via the tape 57. In accordance with the rotation of the shaft 95, the roller 46, the platen roller 78 and the movable feed roller 79, the print tape and the ink ribbon inside the tape cassette 30 are fed along the feed path C. Printing is performed by the thermal head 10 on the tape, using the ink ribbon.

Figure 4:
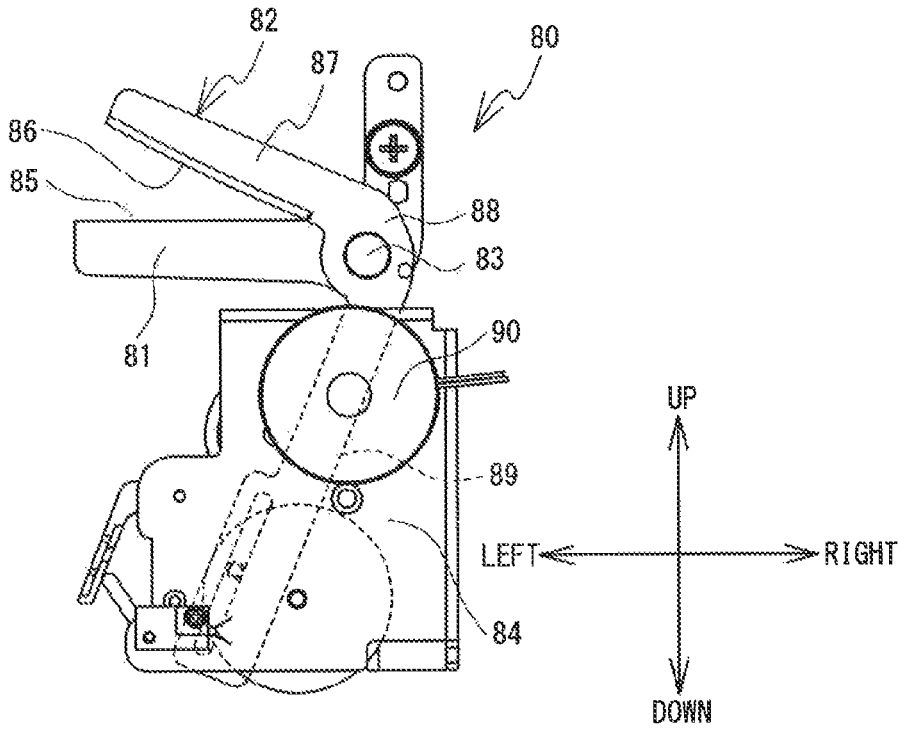
FIG. 4 is a front view of a cutting mechanism.

The cutting mechanism 80 will be explained with reference to FIG. 3 and FIG. 4. The cutting mechanism 80 is a known hinge-type cutting mechanism, and is configured to create a label by cutting the printed tape 57 at a predetermined length. The predetermined length is, for example, prescribed by data transmitted from the computer device (not shown in the drawings). As shown in FIG. 3, the cutting mechanism 80 is provided between the cassette mounting portion 8 and the discharge portion 99 in the front-rear direction. As shown in FIG. 4, the cutting mechanism 80 is provided with a fixed blade 81, a movable blade 82, a hinge portion 83, a support plate 84 and a motor 90. The fixed blade 81 is provided such that it extends in the left-right direction, and is provided with a blade portion 85 on the upper side thereof. The movable blade 82 is formed substantially in a V shape or an L shape in a front view. More specifically, the movable blade 82 includes a blade portion 86, a hilt portion 87, a curved portion 88 and a transmission portion 89. The blade portion 86 is formed below the hilt portion 87, such that the blade portion 86 faces the blade portion 85 of the fixed blade 81. The curved portion 88 is provided such that it connects the hilt portion 87 and the transmission portion 89. The hinge portion 83 is provided on the curved portion 88. The movable blade 82 is supported by the support plate 84 so that it can pivot with the hinge portion 83 as the fulcrum. The motor 90 is fixed to the front surface of the support plate 84, and is provided such that it can perform rock-driving of the movable blade 82. The movable blade 82 rocks as a result of the driving force of the motor 90 being transmitted to the transmission portion 89 of the movable blade 82, via a gear portion (not shown in the drawings) that is provided on the back surface of the support plate 84. The tape 57 that is clamped between the blade portion 85 and the blade portion 86 is cut by the rocking of the movable blade 82. The label is created in this manner.

Figure 5:
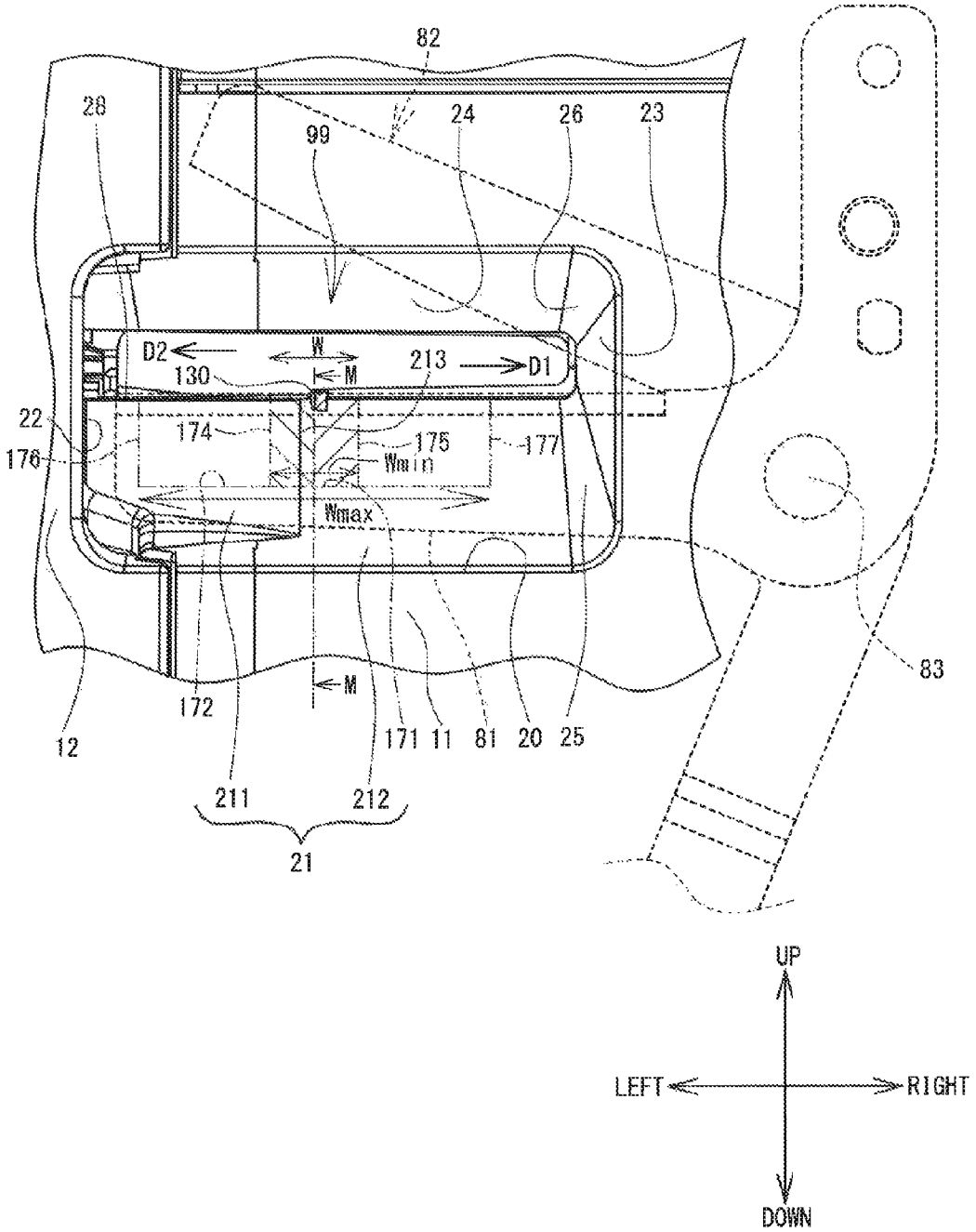
FIG. 5 is a partial enlarged front view in which a surrounding of a discharge portion is enlarged.
Figure 6:
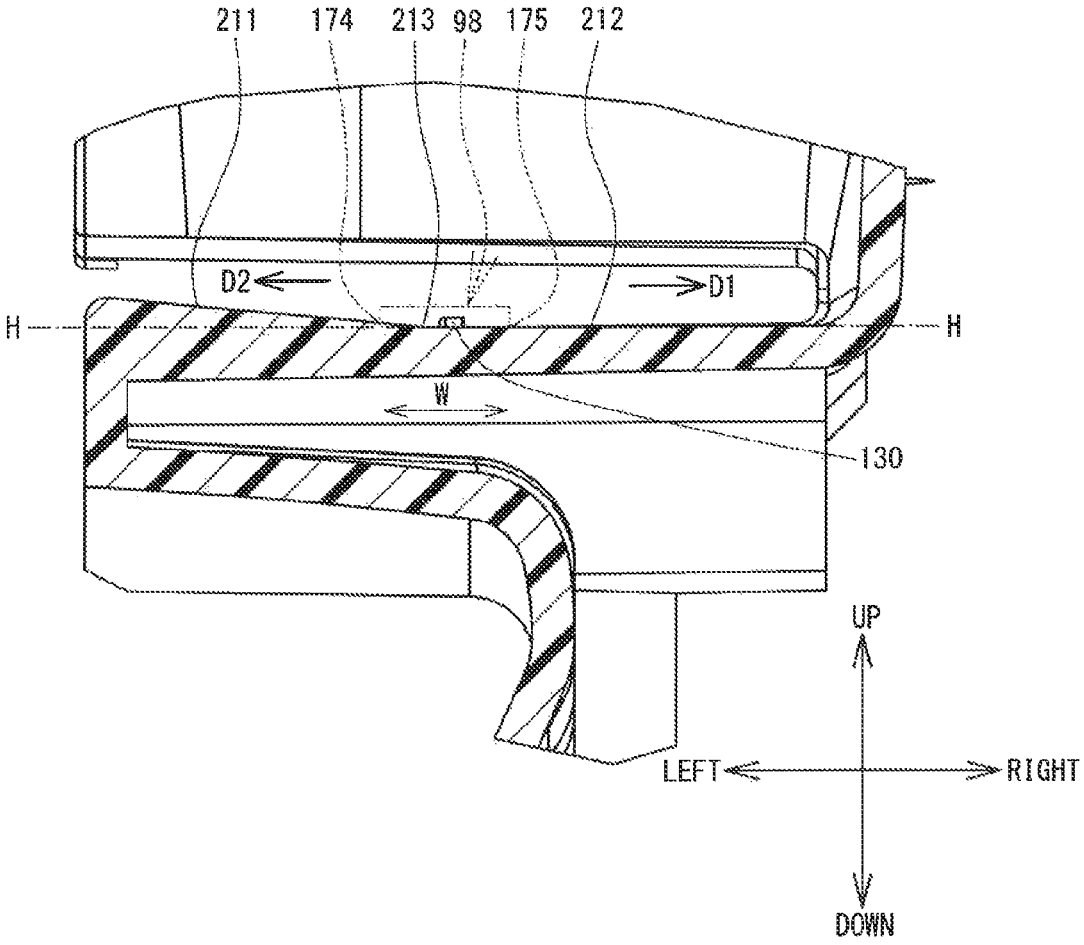
FIG. 6 is a partial cross-sectional view taken in the direction of arrows on a line 6-6 shown in FIG. 3.

The discharge portion 99 will be explained with reference to FIG. 3, FIG. 5 and FIG. 6. The discharge portion 99 is provided with the discharge port 20. The discharge portion 99 is a portion that is provided between the cutting mechanism 80 and the discharge port 20. The discharge portion 99 is configured to discharge the label that has been created by the cutting mechanism 80 to the outside of the tape printer 1 from the discharge port 20. As shown in FIG. 3, the discharge port 20 is provided in an extending direction (the direction in which the tape 57 is fed on the feed path C) D of the feed path C of the tape 57, and is formed in a rectangular shape whose longer sides are in the left-right direction in a front view. As shown in FIG. 5, the discharge portion 99 is provided with a horizontal surface 28, a guide portion 21 and surfaces 22 to 26. The horizontal surface 28 is a surface that is provided extending in the horizontal direction and is provided in a lower rear portion of the discharge portion 99. The guide portion 21 and the surfaces 22, 23, 24, 25 and 26 are provided, respectively, on the lower side, the left side, the right side, the upper side, the lower right side and the upper right side of the discharge portion 99.

Figure 7:
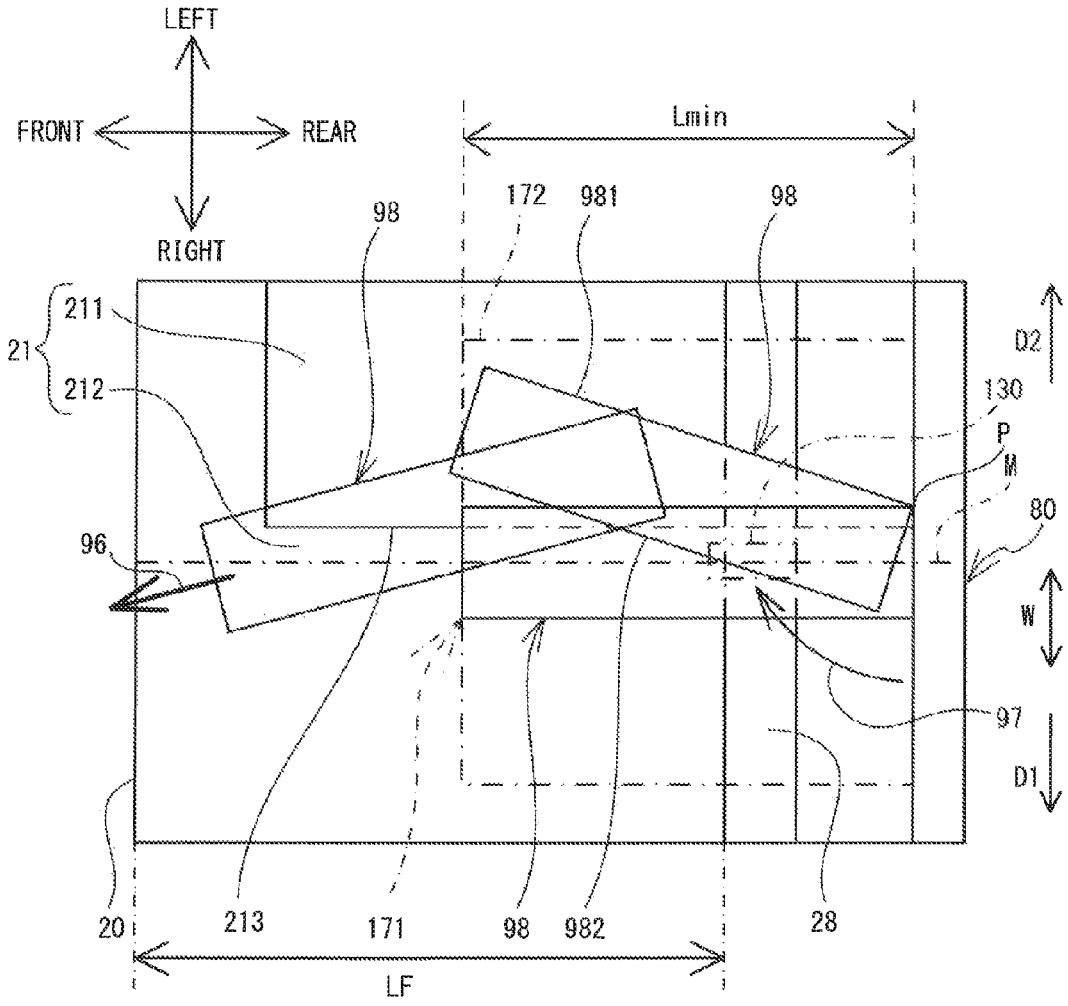
FIG. 7 is an explanatory diagram schematically showing a plan view of a discharge path of a minimum width minimum length label.

The guide portion 21 is provided between the cutting mechanism 80 and the discharge port 20, and is formed such that it guides the label toward the discharge port 20 while supporting a surface of the label. In the present embodiment, the above-mentioned surface of the label is the bottom surface of the label. As shown in FIG. 5, the length of the guide portion 21 in the width direction W of the feed path C is larger than the maximum tape width Wmax. In the present embodiment, when the tape cassette 30 is mounted in the tape printer 1, the width direction of the tape matches the width direction of the feed path C. Thus, in the present specification, the same reference symbol W is assigned to the width direction of the tape and the width direction of the feed path C. As schematically shown in FIG. 7, a length LF of the guide portion 21 in the lengthwise direction toward the discharge port 20 is longer than a minimum length Lmin of the tape 57. A value of the minimum length Lmin is determined by a head-to-cutter distance Lhc (not shown in the drawings). The head-to-cutter distance Lhc is the distance between the thermal head 10 and the cutting mechanism 80. Normally, the value of the minimum length Lmin is larger than the distance Lhc by a rear margin length. The rear margin length is a length in the extending direction D of a margin that is set on the rear side of the tape. In the present embodiment, the minimum length Lmin is 24.5 mm. The rear portion of the guide portion 21 is connected to the horizontal surface 28.

The guide portion 21 is provided with a first guide portion 211 and a second guide portion 212. The first guide portion 211 and the second guide portion 212 are provided such that they are arrayed in the width direction W of the tape. In addition, the first guide portion 211 and the second guide portion 212 are mutually connected by a connecting portion 213. As shown in FIG. 5, the connecting portion 213 is formed on the end of the first guide portion 211 that is on the side of the hinge portion 83 (the side indicated by an arrow D1, hereinafter simply abbreviated to a hinge portion side). The first guide portion 211 includes a side 174 (of a projected graphic 171) on the side opposite to the hinge portion side (the side indicated by an arrow D2, hereinafter simply abbreviated to a blade tip side). The projected graphic 171 is a graphic that is formed when a minimum width minimum length tape is projected onto the guide portion 21 from a direction orthogonal to the feed path C (refer to FIG. 3). The minimum width minimum length tape refers to a tape when a minimum width tape (which is a tape of the minimum tape width) is fed by the minimum length Lmin from the cutting mechanism 80 in the extending direction D. Further, the first guide portion 211 includes a side 176 (of a projected graphic 172) on the blade tip side. The projected graphic 172 is a graphic that is formed when a maximum width minimum length tape is projected onto the guide portion 21 from the direction orthogonal to the feed path C (refer to FIG. 3). The maximum width minimum length tape refers to a tape when a maximum width tape (which is a tape of the maximum tape width) is fed by the minimum length Lmin from the cutting mechanism 80 in the extending direction D.

The projected graphic 171 of the present embodiment is projected onto a central portion of the guide portion 21 in the left-right direction. An area that is encompassed by the projected graphic 171 is an area indicated by shading using diagonal lines that extend downward to the right and upward to the right in FIG. 5. The tape printer 1 of the present embodiment is provided with a protruding portion 130 in the vicinity of a boundary between the guide portion 21 and the horizontal surface 28. The protruding portion 130 is within the area inside the projected graphic 171, and is provided on the central line M of the projected graphic 171 in the width direction W of the feed path C.

Taking the connecting portion 213 as a reference, the height of the first guide portion 211 has a tendency to increase, with respect to the reference, toward the blade tip side in the width direction W of the feed path C. The tendency to increase of the height here refers to a macroscopic increase in the height with respect to the reference (even where there are areas in which there is a microscopic decrease) toward the side that is opposite to the connecting portion 213 in the width direction W. More specifically, the tendency to increase of the height refers to a situation in which there are more cases of increase than cases of decrease, when comparing average values of the height with respect to the reference over a section of the predetermined length in the width direction W with average values of the height with respect to the reference over a section adjacent to that section on the hinge portion side. Therefore, the tendency to increase includes, for example, a case in which the height with respect to the reference increases in the width direction W of the feed path C in a straight line, in a curved line (such as, an upwardly convex curved line or a downwardly concave curved line), and in a stepped shape. As shown in FIG. 6, the first guide portion 211 of the present embodiment is provided such that the height of the first guide portion 211 with respect to the connecting portion 213 increases in a straight line toward the blade tip side, in the width direction W of the feed path C.

The second guide portion 212 is provided such that it is connected to the first guide portion 211 on the hinge portion side of the first guide portion 211. The second guide portion 212 includes a side 175 (of the projected graphic 171) on the hinge portion side. In addition, the second guide portion 212 includes a side 177 (of the projected graphic 172) on the hinge portion side. The height of the second guide portion 212 with respect to the above-described reference has a tendency to be constant in the width direction W of the feed path C. The tendency to be constant indicates that the height from the reference, toward the blade tip side in the width direction W of the feed path C, is approximately constant in a macroscopic sense, even if there is a certain amount of increase or decrease. More specifically, the tendency to be constant refers to a situation in which there are approximately the same number of cases of decrease and increase, when comparing average values of the height with respect to the reference over the section of the predetermined length in the width direction W of the feed path C with average values of the height with respect to the reference over a section adjacent to that section on the hinge portion side. As shown in FIG. 6, the second guide portion 212 of the present embodiment is provided such that the height of the second guide portion 212 with respect to the connecting portion 213 is uniform toward the blade tip side, in the width direction W of the feed path C. In other words, the second guide portion 212 is provided extending in a horizontal direction H in the width direction W of the feed path C.

A portion of the connecting portion 213 that is included within the projected graphic 171 is in an area (an area illustrated by the shading extending downward to the right in FIG. 5) that is inside a graphic on the blade tip side, of two graphics that are obtained by equally dividing the projected graphic 171 in the width direction W of the feed path C. The connecting portion 213 of the present embodiment is provided such that it extends in a straight line in the front-rear direction.

As described above, the guide portion 21 is provided with the first guide portion 211 and the second guide portion 212. Therefore, the label is supported at two points in the width direction W of the feed path C. In other words, the side 175 of the label on the hinge portion side is supported by the second guide portion 212, and the side 174 of the label on the blade tip side is supported by the first guide portion 211. Thus, the label tilts with respect to the horizontal direction H and the label is thus subject to a force toward the hinge portion side. In the tape printer 1 having the above-described structure, friction between the guide portion 21 and the label is small in comparison to a case in which the whole bottom surface of the label comes into contact with the guide portion 21. Therefore, in the tape printer 1 having the above-described structure, the label is more easily discharged in comparison to the case in which the whole bottom surface of the label comes into contact with the guide portion 21. This effect is particularly evident when using the minimum width minimum length label.

Further, the tape printer 1 of the present embodiment is provided with the protruding portion 130 in the vicinity of the boundary of the guide portion 21 and the horizontal surface 28. The label that is cut by the cutting mechanism 80 is supported by the protruding portion 130. Thus, in comparison to a case in which the protruding portion 130 is not provided, in the tape printer 1 having the above-described structure, it is possible to reduce the friction that occurs between the bottom surface of the label and the discharge portion 99. As a result, in the tape printer 1 having the above-described structure, the label is more easily discharged from the discharge port 20, in comparison to the case in which the protruding portion 130 is not provided.

Operations at a time of printing by the tape printer 1 will be briefly explained with reference to FIG. 3 and FIG. 7, using as an example a case in which a minimum width minimum length label 98 is created when the laminate type tape cassette 30 is mounted in the cassette mounting portion 8. The roller 46 that is rotationally driven via the shaft 100 pulls out a film tape (not shown in the drawings) that is wound on the spool 41, in cooperation with the movable feed roller 79. Further, the spool 44 that is rotationally driven via the shaft 95 pulls out an unused ink ribbon (not shown in the drawings) from the spool 42, in synchronization with a printing speed. The film tape that is pulled out from the spool 41 is fed along the feed path C while passing on the outside of the spool 42. In addition, the film tape is fed between the thermal head 10 and the platen roller 78 in a state in which the top surface of the film tape is overlaid with the ink ribbon. The thermal head 10 performs printing of characters on a print surface of the film tape, using the ink ribbon.

After that, the used ink ribbon is peeled away from the printed film tape, and is taken up by the spool 44. Meanwhile, a double-sided adhesive tape (not shown in the drawings) is pulled out from the spool 40 by the roller 46 and the movable feed roller 79 moving together in concert. The double-sided adhesive tape is overlaid on the print surface of the printed film tape and adhered thereto, while being guided between the roller 46 and the movable feed roller 79. The printed film tape (that is, the tape 57), to which the double-sided adhesive tape has been adhered to the print surface thereof, is cut by the cutting mechanism 80 in a state in which the tape 57 is further fed toward the discharge port 20 by a predetermined length.

As schematically shown in FIG. 7, the minimum width minimum length label 98 that has been obtained by being cut by the cutting mechanism 80 is subject to a force in the direction of an arrow 97. In this way, the minimum width minimum length label 98 is rotated in the clockwise direction in a plan view. The protruding portion 130 is formed in an area, of the projected graphic 171, that includes a portion relatively close to the boundary between the horizontal surface 28 and the guide portion 21, and is formed on the central line M that is central in the left-right direction. Therefore, the minimum width minimum length label 98 reliably comes into contact with the protruding portion 130, even when the minimum width minimum length label 98 rotates in the direction of the arrow 97 around an end point P on the blade tip side in the width direction W of the feed path C, after being subject to the force from the cutting mechanism 80 in the direction of the arrow 97.

Furthermore, at least a part of a left side 981 of the minimum width minimum length label 98, which is the side on the blade tip side, is supported by the first guide portion 211. At least a part of a right side 982 of the minimum width minimum length label 98, which is the side on the hinge portion side, is supported by the second guide portion 212. In this way, the minimum width minimum length label 98 tilts downward and to the right with respect to the horizontal direction H, in the width direction W of the feed path C. In other words, the minimum width minimum length label 98 is subject to a force in the direction of the hinge portion side. When this happens, a movement direction of the minimum width minimum length label 98 is corrected and the minimum width minimum length label 98 moves in the direction indicated by an arrow 96. In this way, even when the length LF of a guide surface 27 is longer than the length Lmin, the minimum width minimum length label 98 is discharged from the discharge port 20, while sticking to the guide portion 21 is favorably suppressed. In a similar manner, also with respect to a label other than the minimum width minimum length label 98, the label is discharged from the discharge port 20, while sticking to the guide portion 21 is favorably suppressed.

In the above-described tape printer 1, the hinge portion 83, the cutting mechanism 80 and the discharge port 20 correspond, respectively, to a hinge portion, a cutting portion and a discharge port of the present disclosure. The first guide portion 211, the second guide portion 212, the connecting portion 213 and the guide portion 21 correspond, respectively, to a first guide portion, a second guide portion, a connecting portion and a guide portion of the present disclosure.

In the tape printer 1, the label that is obtained by cutting the tape 57 is supported by the first guide portion 211 and the second guide portion 212. The tendency of the change in height with respect to the reference, in the width direction W of the feed path C, is different for the first guide portion 211 and the second guide portion 212. As a result, at least a part of the bottom surface of the label is in a state of being separated from the guide portion 21. Therefore, the friction between the guide portion 21 of the tape printer 1 and the label is smaller in comparison to a case in which the whole bottom surface of the label is in contact with the guide portion. Specifically, reducing friction between the guide portion 21 of the printer 1 and the label suppresses static generation . . . . Thus, in the tape printer 1 having the above-described structure, the label is more easily discharged in comparison to the case in which the whole bottom surface of the label is in contact with the guide portion 21.

In the type of tape printer that is provided with the hinge type cutting mechanism 80, the label that is obtained by cutting the tape is subject to a force, due to the cutting operation by the cutting mechanism 80, that causes the label to rotate (refer to the arrow 97 in FIG. 7) around an origin point that is the end point on the blade tip side in the width direction W of the feed path C (the end point P in the case of the minimum width minimum length label 98). In other words, the label that is obtained by cutting the tape is guided by the guide portion 21 to the discharge port 20 while rotating around the end point (as the origin point) on the blade tip side in the width direction W of the feed path C of the tape. The influence of the force from the cutting mechanism 80 is larger when the tape width is narrow in comparison to when the tape width is wider, and is larger when the tape length is shorter in comparison to when the tape length is longer. Specifically, the conditions applying to the label that is subject to the largest influence from the cutting mechanism 80 are those of the minimum width minimum length label 98, which has the minimum tape width and the minimum tape length. In the tape printer 1, the minimum width minimum length label 98 moves smoothly toward the discharge port 20 as the movement direction is corrected to the hinge portion side by the guide portion 21. According to the tape printer 1 with the above-described structure, even when the distance from the position at which the tape is cut to the discharge port 20 is relatively large and under the conditions in which the influence of the force from the cutting mechanism 80 is largest, the label is smoothly discharged from the discharge port 20.

In the tape printer 1, a portion of the connecting portion 213 that is included within the projected graphic 171 is in an area within the graphic on the blade tip side, of the two graphics that are obtained by equally dividing the projected graphic 171 in the width direction W of the feed path C. In the tape printer 1 with the above-described structure, at least a part of the bottom surface of the label is in a state of being reliably separated from the guide portion 21. The friction between the guide portion 21 of the tape printer 1 and the label is small in comparison to the case in which the whole bottom surface of the label is in contact with the guide portion 21. Thus, in the tape printer 1 with the above-described structure, the label is more easily discharged in comparison to the case in which the whole bottom surface of the label is in contact with the guide portion 21.

In the tape printer 1, the connecting portion 213 extends in the front-rear direction in a straight line. As a result, according to the tape printer 1 with the above-described structure, it is possible to discharge the label smoothly from the discharge port, in comparison to a case in which the connecting portion 213 is not formed in a straight line.

The tape printer of the present disclosure is not limited to the above-described embodiment, and various modifications may be made without departing from the spirit and scope of the present disclosure. For example, one of the following modifications (A) to (C) may be made as appropriate.

(A) The type of the tape cassette that can be mounted in the tape printer, and the type and structure of the tape that can be housed in the tape cassette may be changed as appropriate. For example, each of the minimum value and the maximum value of the tape width may be changed as appropriate. When the tape printer can perform printing on each of a plurality of types of tape having mutually different widths, the central line M of the feed path of each of the tapes need not necessarily match. In this case, the tape printer may feed the tape while aligning a selected one side of the tape such that the position of the one side of the tape matches, for each of the tapes, in the width direction. The tape printer may be able to feed the tape of only one type of tape width. The structure of the cassette mounting portion of the tape printer may be changed as appropriate depending on the structure of the tape cassette. The minimum length Lmin of the tape may be changed as appropriate. As long as it is able to cut the tape, the cutting mechanism 80 may be a vertical slide type cutting mechanism or the like.

(B) The arrangement of the hinge portion 83 on the cutting mechanism 80 may be on the side of one end in the width direction W of the feed path C of the tape. The arrangement of the first guide portion 211 and the second guide portion 212 may be changed as appropriate depending on the arrangement of the hinge portion 83.

(C) The first guide portion 211 and the second guide portion 212 need not necessarily be formed in a straight line in the width direction W of the feed path C. For example, at least one of the first guide portion 211 and the second guide portion 212 may be formed with ribs or grooves that extend in the front-rear direction, and thus formed in a wave shape in the width direction W of the feed path C. A range of extension of the first guide portion 211 in the extending direction D may be wider than a range of extension of the projected graphic 171. For example, the first guide portion 211 may be provided such that it extends, in the extending direction D, to the discharge port 20 or to the vicinity of the discharge port 20. The connecting portion 213 need not necessarily be provided extending in a straight line. It is sufficient that the connecting portion 213 be within the projected graphic 171.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A tape printer configured to perform printing on a tape and to create a label by cutting the printed tape, the tape printer comprising:

a cutting portion configured to cut the tape that is fed along a feed path;

a discharge port configured to discharge the label that is created as a result of the tape being cut by the cutting portion, the discharge port being provided on a downstream side of the cutting portion in an extending direction of the feed path; and a guide portion located between the cutting portion and the discharge port in such a manner as to guide the label created by the cutting portion to the discharge port while supporting one surface of the label, the guide portion including:

a first guide portion that is arranged on a first end side with respect to a central line in a width direction of the feed path, the first guide portion not including the central line in the width direction of the feed path, a second guide portion connected to the first guide portion, the second guide portion being arranged on a second end portion side in the width direction of the feed path, the second guide portion including the central line, and a connecting portion that is a portion connecting the first guide portion and the second guide portion, the second end portion side being opposite to the first end portion side in the width direction with respect to the connecting portion, wherein:

the first guide portion extends from the connecting portion toward the first end portion side in the width direction such that a first part of the label is disposed on the first guide portion when the label is guided by the guide portion, the first part including a first widthwise end of the label, the second guide portion extends from the connecting portion toward the second end portion side in the width direction such that a second part of the label is disposed on the second guide portion when the label is guided by the guide portion, the second part including a second widthwise end of the label, when the connecting portion is taken as a reference, the first guide portion is formed such that a height of the first guide portion with respect to the reference substantially increases toward the first end portion side in the width direction, the second guide portion is formed such that a height of the second guide portion with respect to the reference is substantially uniform in the width direction, and the first guide portion including an end supporting portion that is a portion on which the first widthwise end of the label is disposed when the first part is disposed on the first guide portion, a height of the end supporting portion with respect to the reference is greater than the height of the second guide portion with respect to the reference.

2. The tape printer according to claim 1, wherein the cutting portion has a hinge portion on the second end portion side in the width direction.

3. The tape printer according to claim 2, wherein a portion of the connecting portion overlaps with a part of the label guided by the guide portion when viewed in a direction orthogonal to the feed path and the width direction, the part of the label being on the second end portion side of two parts that are obtained by dividing the label equally in the width direction.

4. The tape printer according to claim 2, wherein the connecting portion is formed in a straight line.

5. The tape printer according to claim 2, further comprising:

a protruding portion provided on the central line and on a boundary between the guide portion and a horizontal surface portion, the horizontal surface portion being a flat surface provided on an upstream side of the guide portion in the extending direction of the feed path, a projecting end of the protruding portion being positioned between the second guide portion and the end supporting portion in a height direction orthogonal to the feed path and the width direction.

* * * * *